United States Patent [19]

Doughty

[11] Patent Number: 4,471,177

[45] Date of Patent: Sep. 11, 1984

[54] ENLARGED SWITCH AREA MEMBRANE SWITCH AND METHOD

[75] Inventor: John I. Doughty, White Bear Lake, Minn.

[73] Assignee: Press On, Inc., Stillwater, Minn.

[21] Appl. No.: 407,820

[22] Filed: Aug. 13, 1982

[51] Int. Cl.[3] ..... H01H 13/70

[52] U.S. Cl. ..... 200/5 A; 200/86 R

[58] Field of Search ..... 200/1 R, 5 R, 5 A, 61.43, 200/86 R

[56] References Cited

U.S. PATENT DOCUMENTS

| | | | |
|---|---|---|---|
| Re. 28,365 | 3/1975 | Braue | 200/86 |
| 3,693,026 | 9/1972 | Miller | 200/61.43 X |
| 3,705,276 | 12/1972 | Seeger et al. | 200/5 |
| 3,721,778 | 3/1973 | Seeger et al. | 200/5 |
| 3,723,673 | 3/1973 | Clary et al. | 200/1 R |
| 3,773,998 | 11/1973 | Seeger et al. | 200/159 |
| 3,780,237 | 12/1973 | Seeger et al. | 200/5 |
| 3,784,768 | 1/1974 | Hunt | 200/86 R |
| 3,789,167 | 1/1974 | Seeger et al. | 200/5 |
| 3,860,771 | 1/1975 | Lynn et al. | 200/5 |
| 3,862,381 | 1/1975 | Glaister et al. | 200/5 |
| 3,862,382 | 1/1975 | Glaister et al. | 200/5 |
| 3,879,593 | 4/1975 | Larson | 200/159 |
| 3,886,335 | 5/1975 | Hendricks | 200/1 R |
| 3,950,846 | 4/1976 | Johnson | 29/630 |
| 3,959,610 | 5/1976 | Finnegan et al. | 200/5 |
| 3,968,336 | 7/1976 | Johnson | 200/5 |
| 3,978,297 | 8/1976 | Lynn et al. | 200/5 |
| 4,017,697 | 4/1977 | Larson | 200/5 |
| 4,035,593 | 7/1977 | Riniker | 200/5 |
| 4,046,975 | 9/1977 | Seeger | 200/5 |
| 4,055,735 | 10/1977 | Eachus et al. | 200/5 |
| 4,056,699 | 11/1977 | Jordan | 200/5 |
| 4,066,851 | 1/1978 | White et al. | 200/5 |
| 4,066,854 | 1/1978 | Zenk et al. | 200/5 |
| 4,078,257 | 3/1978 | Bagley | 364/900 |
| 4,090,045 | 5/1978 | Marsh | 200/5 |
| 4,096,364 | 6/1978 | Lynn et al. | 200/5 |
| 4,128,744 | 12/1978 | Seeger | 200/5 |
| 4,143,253 | 3/1979 | Wagner et al. | 200/5 |
| 4,162,792 | 7/1979 | Chang et al. | 273/85 |
| 4,172,216 | 10/1979 | O'Shea | 200/85 |
| 4,264,477 | 4/1981 | Seeger et al. | 252/503 |
| 4,356,358 | 10/1982 | Fukukura | 200/5 A |

*Primary Examiner*—J. R. Scott

*Attorney, Agent, or Firm*—Merchant, Gould, Smith, Edell, Welter and Schmidt

[57] ABSTRACT

A membrane switch (10) is the subject matter of this patent application. The switch (10) includes first and second switch networks connected in parallel to effect a particular function. Spacer bridges (50, 52) are interposed in the first and second switch networks to preclude inadvertent engagement of contacts on lamina surfaces (14, 16, 28, 30). The bridges (50) of the first network are either adjacent or spaced from all bridges (52) of the second network in order to insure that the application of pressure to one of two external laminae (22, 24) will activate at least one of the switch networks.

6 Claims, 4 Drawing Figures

ENLARGED SWITCH AREA MEMBRANE SWITCH AND METHOD

TECHNICAL FIELD

The invention of the present application deals broadly with the field of membrane switches (e.g., switches wherein membranes either being conductive in themselves or having conductive networks screened thereon are brought into engagement with one another to close a circuit in order to effect a particular function). More specifically, the invention is directed to such a switch wherein the area of one membrane which is desired to be brought into engagement with another membrane is relatively large. The invention is a membrane switch which, even though having a large engagement area, will preclude inadvertent actuation.

BACKGROUND OF THE INVENTION

Various types of membrane or pressure sensitive switches are known in the art. Such switches typically comprise a pair of resilient laminae, typically made of a polyester material. A typical manner in which the switch is formed is one wherein a silver conductive ink circuit is screen printed onto a side of one lamina facing the opposite lamina. A pad circuit formed from silver conductive ink is screen printed onto the other lamina on a side facing the first lamina and at a location such that the circuit and pad circuit will be superimposed upon one another when the two laminae are in engagement.

A spacer sheet is interposed between the laminae and has a window cut out at the location of the circuit network and pad circuit. The spacer can also be manufactured of a polyester material and can be secured to the laminae by a pressure sensitive material.

With such an arrangement and cooperation of the various components of the switch, the switch is normally in a position wherein the circuit network and pad circuit are out of engagement. Because of the flexible nature of the laminae, however, when tactile or other pressure is applied to one of the laminae at the location of the window, the conductive ink screens printed on the laminae will be made to engage one another to complete a circuit. Completion of a circuit in this manner can, in turn, effect a particular function depending upon the application to which the switch is put.

Numerous applications exist for such membrane switches. Illustrative of some of the applications to which such switches can be put are functional controls for microwave ovens, dispensing switches for vending machines, keyboards for computers, and innumerable other specific applications.

In some of such applications, it is desirable, for various reasons, to utilize a membrane switch having a large activation area. The requirement for such a switch, however, presents unique problems. Self actuation can occur if the window in the spacer between the laminae is too large. The ease with which inadvertent actuation occurs as the window is enlarged is, of course, a function of the thickness of the spacer. Since spacer thickness is one way in which a switch is made more course, enlargement of the window, even if not effecting undesired actuation, will make the switch more sensitive. It can be seen, therefore, that, as the window is enlarged, the switch will not operate in the manner in which it ws originally designed to operate.

It has been found that, when using a spacer having a seven mil thickness, if the smaller dimension of the window is made to exceed three quarters of an inch, inadvertent closing of the switch can occur. If the same switch is provided with a spacer having a thickness of, for example, ten mils in order to provide for more course actuation, as the smaller dimension of the window is made to exceed three quarters of an inch, although the switch might not immediately become susceptible to inadvertent closing, it will become more sensitive than what is desired.

In some applications which have previously been discussed (i.e., vending machine actuation switches) it is desirable to have a switch having a smaller dimension significantly in excess of three quarters of an inch. The invention of the present application is a membrane switch which solves the problems of the prior art as discussed above. It can have virtually unlimited dimensions without either being more susceptible to inadvertent actuation or altering the sensitivity of the switch.

SUMMARY OF THE INVENTION

The invention of the present application is a membrane switch having a large area for activation. The area is sufficiently large, laminae carrying switch contacts are sufficiently resilient, and the spacing at which the laminae are maintained from one another is sufficiently small so that, absence the presence of the present application, the contacts would become engaged inadvertently to complete a circuit and effect the designed function of the circuit. The switch includes a first network having a contact applied one surface of a lamina. A second contact or conductive pad is applied to a surface of a second lamina facing the first surface to which the contact is applied. The pad is spaced from, but engagable with, the contact applied to the first surface along at least portions thereof to close the firt network upon application of pressure urging the surfaces toward one another. Spacer bridges intemediate the surfaces are provided at intervals to provide sufficient support for one lamina relative to the other so that inadvertent engagement of the contacts will be precluded. The membrane switch includes a second network which is wired in parallel with the first switch network. The second network is positioned relative to the first in an overlying relationship. As in the case of the first network, the second network includes a contact applied to a surface of a first lamina. A second contact, or conductive pad, is applied to a surface of a second lamina facing the surface of the first. At least one spacer bridge is interposed between the laminae to maintain them in a normally spaced relationship. The contact and conductive pad are engagable upon the application of pressure to the laminae urging the second network surfaces together. The spacer bridge or bridges of the second network are positioned relative to those of the first network so that not one is in an overlying relationship to any of the bridges of the first network.

In a preferred embodiment, the two networks can share a common lamina. The common lamina can have silver conductive ink screen printed onto oppositely facing surfaces thereof to serve as either the contact or conductive pad of one of the two networks.

Spacers defining the network engagement areas can be provided. In such an embodiment, the spacers would define overlying windows size to a degree in accordance with the desired size of the membrane switch.

The spacer bridges would be disposed within the bounds of the windows.

In one embodiment, the spacer bridges can be elongated. In such an embodiment, they can be positioned generally parallel with respect to the axes of elongation.

The invention of the present application is, thus, an improved membrane switch which provides a large actuation area but which, yet, minimizes the possibility of inadvertent actuation. More specific features and advantages obtained in view of those features will become apparent with reference to the detailed description of the invention, appended claims, and accompanying drawing figures.

DETAILED DESCRIPTION OF THE INVENTION

Figure 1:
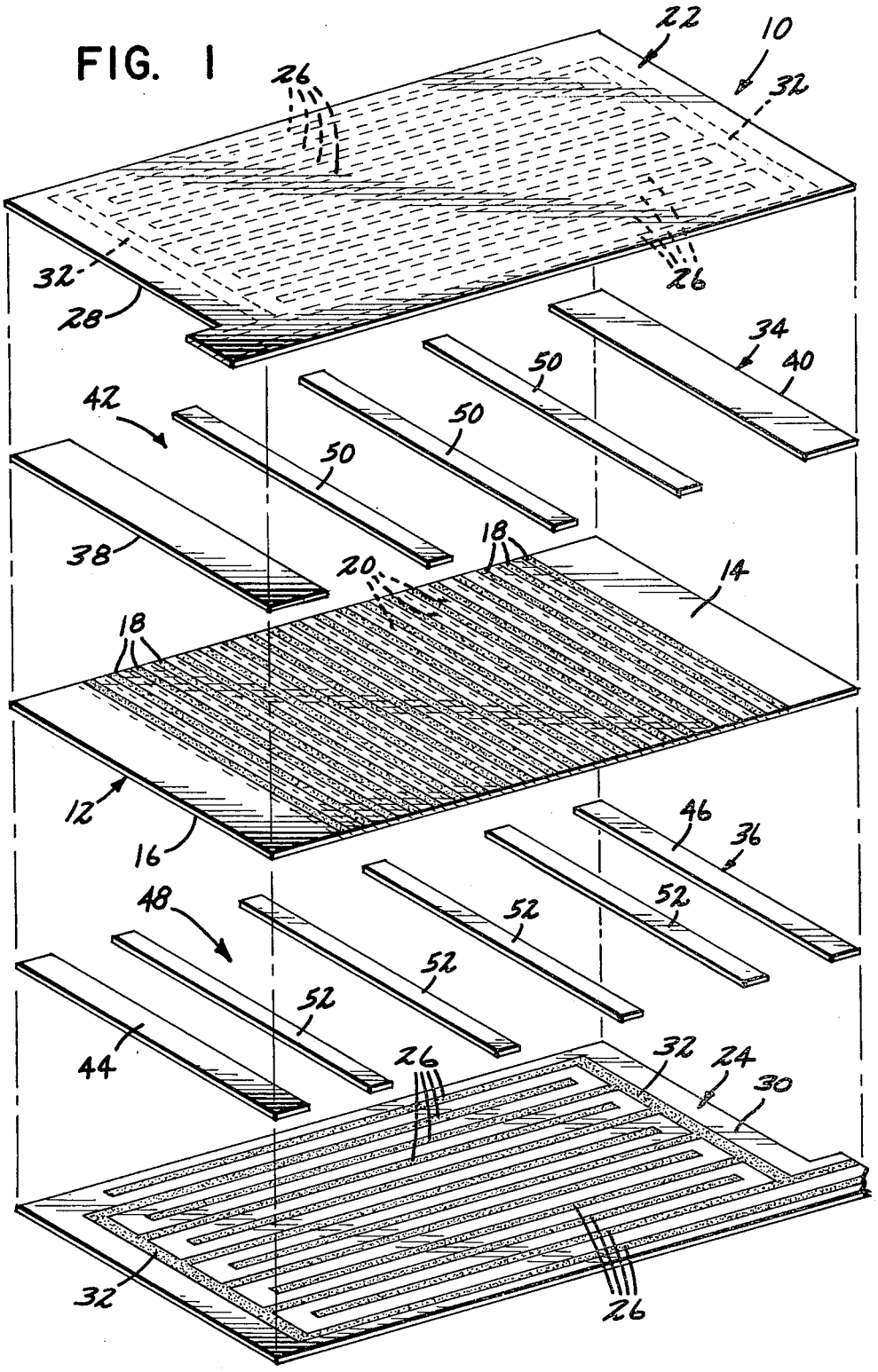
FIG. 1 is an exploded view, in perspective, of a membrane switch in accordance with the invention of the present application.

Referring now to the drawings wherein like reference numerals denote like elements throughout the several views, FIG. 1 illustrates, in an exploded perspective view, a membrane switch 10 in accordance with the invention of the present application. The switch 10 includes first and second switch networks, each similar in construction to the other. Each network includes a pair of surfaces, generally parallel to each other, and in opposing relationship. Although not essential to the invention, the figures show a structure wherein a central lamina 12 has oppositely facing surfaces 14, 16, and wherein the surfaces 14, 16 of the central lamina 12 form one of the surfaces of each of the networks.

The central lamina 12 can be manufactured from a polyester material. In a preferred embodiment, it is seven mils in thickness and has conductive traces 18, 20 screen printed on both sides 14, 16 thereof. As known in the art, the traces can be an application of silver conductive ink.

As seen in the figures, the traces 18, 20 are elongated and extend generally in a parallel fashion with respect to one another. Depending upon the particular application to which the switch 10 is to be put, the traces 18, 20 on each surface of the central lamina 12 can function as either shorting bars to close contacts screen printed on opposing surfaces of spaced laminae 22, 24 as discussed hereinafter, or as a contact in themselves. As seen in the figures, however, the traces, or pads, are shown as shorting bars and wherein two contacts in a circuit switch are screen printed onto the surfaces of the external laminae 22, 24.

Figures 2, 3, 4:
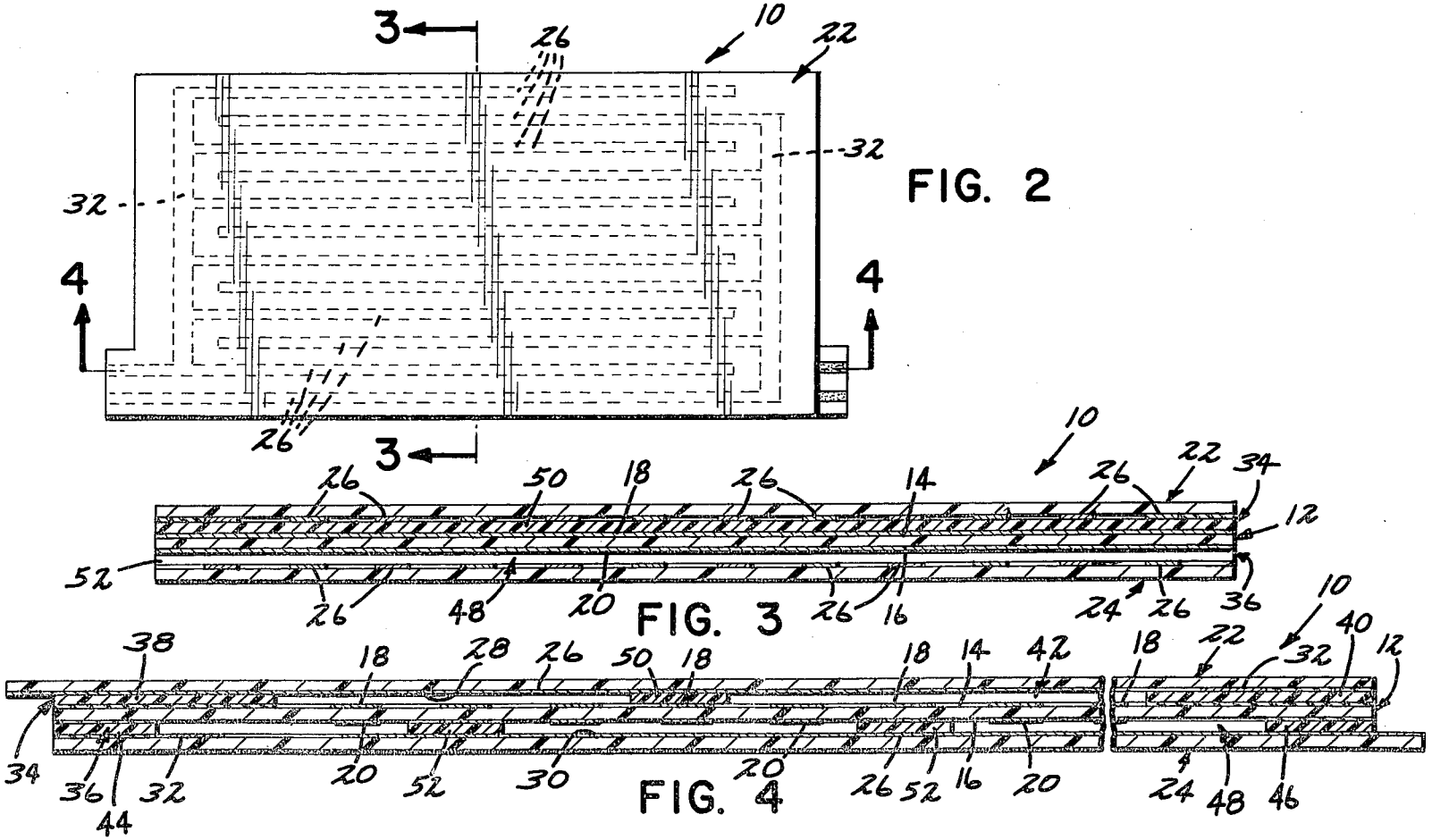
FIG. 2 is a plan view of the membrane switch of FIG. 1.
FIG. 3 is a sectional view taken generally along the line 3—3 of FIG. 2.
FIG. 4 is a sectional view taken generally along the line 4—4 of FIG. 2.

Each switch network is shown, as previously indicated, as including an external lamina 22,24. As best seen in FIGS. 3 and 4, the external laminae 22, 24 are closely spaced from the surfaces 14, 16 of the central lamina 12. The figures illustrate a lamina having two contacts, each having a plurality of tines 26, screen printed onto a surface 28, 30 thereof. The tines 26 extend in opposite directions from a base branch 32, and tines 26 of different branches are disposed in an alternating fashion on the surface.

As in the case of the central lamina 12, each of the external laminae 22, 24 can be manufactured from a polyester material. In the preferred embodiment of the switch, they are also provided with a thickness of seven mils.

As previously indicated, each external lamina 22, 24 is closely spaced from one of the surfaces 14, 16 of the central lamina 12. This is accomplished by means of a pair of spacers 34, 36. A first spacer 34 is interposed between the screen printed surface 28 of the first external lamina 22 and one surface 14 of the central lamina 12. As seen in the figures, the spacer 34 is shown as comprising a two-member assembly. Each of the members 38, 40 is positioned intermediate the first external lamina 22 and the central lamina 12 proximate ends thereof.

The spacer members 38, 40 define therebetween a first window 42 or area of switch engagement. It will be understood that, although two laterally spaced members, 38, 40 are shown, the spacer 34 can comprise an integrally formed lamina completely encircling the switch engagement portion on all four sides thereof.

The second spacer 36 is similar in construction to the first. It is shown as including a pair of spacer members, 44, 46 disposed at opposite lateral ends of the switch intermediate the central lamina 12 and the second external lamina 24. The members 44, 46 of the second spacer 36 define a window 48 similar in size to the window 42 defined by the first spacer 34. The windows 42, 48 defined by the first and second spacers 34, 36 are in an overlying relationship.

Each window 42, 48 is shown as having interposed thereacross at least one spacer bridge 50, 52 extending the width of the switch. FIG. 1 illustrates three such bridges 50 interposed in the window 42 defined by the first spacer 34 and four such bridges 52 interposed in the window 48 defined by the second spacer 36. The bridges are illustrated as being elongated and as being parallel with respect to axes of elongation. As best seen in FIG. 4, the bridges traversing the first window 42 and those traversing the second window 48 are out of vertical alignment for a purpose defined hereinafter.

The spacer bridges 50,52 are spaced from spacer members 38, 40, 44, 46 and adjacent bridges by a distance sufficient to maintain the central lamina pad surface 14, 16 and the external lamina contact surface 28, 30 between which they are interposed out of engagement with one another. The distance will vary depending upon the degree of rigidity of the external laminae 22, 24 and the thickness of the spacer 34, 36. It has been found that, when a seven mil polyester material is used for the spacer, the maximum distance that should be allowed between a spacer member 34, 36 and a bridge 50, 52 or two bridges 50, 52 is approximately three quarters of an inch. This will, of course, vary to some degree depending upon the rigidity of the external laminae 22, 24.

As can be seen in view of the disclosure herein, therefore, the membrane switch illustrated, in fact, comprises a pair of switches assembled together in overlying relationship. The switches are designed to effect a particular function, and they are wired in parallel so that actuation of either switch network, in itself, will effect the function.

OPERATION

When the switch 10 is installed in an apparatus in which it functions (i.e. a soft drink vending machine), actuation of a particular function such as dispensing of a product is accomplished by closing the switch. This can be effected by imparting tactile pressure to one of the external laminae 22, 24. As pressure is applied, either one or both of the switch networks will be closed. If the pressure is applied at a location at which a spacer bridge 50 between the first external lamina 22 and central lamina 12 is disposed, the second switch network will be actuated. Similarly, if the pressure is applied at a location at which a spacer bridge 52 interposed between the second external lamina 24 and the central lamina 12 is disposed, the first switch network will be actuated. When either network is actuated, the switch 10 will be closed since the two networks are in a parallel configuration.

As can be seen in view of this disclosure, both switch networks might be actuated simultaneously. This might occur if pressure were applied to one of the external laminae 22, 24 at a location therealong intermediate the dispositions of spacer bridges 50, 52 of the first and second networks. Simultaneous actuation of the networks would, however, accomplish the desired goal of closing the membrane switch 10 the same as if only one of the networks were closed.

In certain embodiments, the switch 10 can be made so that consecutive bridges 50, 52 along the switch 10, irrespective of the laminae between which they are disposed, can be of a dimension wherein their edges are immediately laterally adjacent. In such embodiments, simultaneous actuation of both switch networks would be precluded since pressure could be applied at no point at which the central lamina 12 could be brought into engagement with both the first and second exterior laminae 22, 24. The membrane switch 10 would, still, operate since there would be no overlap of a bridge between the central lamina 12 and one of the external laminae 22, 24 and any of the bridges between the central lamina 12 and the other external lamina.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined by the language in which the appended claims are expressed.

What is claimed is:

1. A membrane switch, comprising:

(a) A first switch network including:

(i) a contact applied to a surface;

(ii) a conductive pad applied to a surface facing said contact surface, said pad being spaced from, but engagable with, said contact along portions thereof to close said first switch network upon application of pressure urging said surfaces toward one another; and (iii) at least one continuous spacer bridge intermediate said contact surface and said conductive pad surface maintaining said contact and pad spaced from one another; and (b) a second switch network wired in parallel with, and overlying, said first switch network, said second switch network including;

(i) a contact applied to a surface;

(ii) a conductive pad applied to a surface facing said second network contact surface, said second network pad being spaced from, but engagable with, said second network contact along portions thereof to close said second switch network upon application of pressure urging said second network contact surface and said second network conductive pad surface toward one another; and (iii) at least one continuous spacer bridge intermediate said second switch contact surface and said second switch conductive pad surface maintaining said second network contact and pad spaced from one another, said at least one second network spacer bridge being one of laterally adjacent, spaced, and out of vertical alignment from said at least one first network spacer bridge, wherein there is substantially no vertical overlap of said at least one first network spacer bridge and said at least one second network spacer bridge.

2. A membrane switch, comprising:

(a) a central lamina having oppositely facing surfaces and electrical contacts applied to each of said surfaces;

(b) a first external lamina having a surface opposite one of said central lamina surfaces and electrical contacts, engagable with said contacts on said central lamina surface to close a first circuit, applied thereto;

(c) a second external lamina having a surface opposite the other of said central lamina surfaces and electrical contacts, engagable with said contacts on said central lamina surface to close a second circuit wired in parallel with said first circuit, applied thereto;

(d) first and second spacers interposed between said first external lamina and said central lamina, and said second external lamina and said central lamina, respectively, said spacers having overlying windows, having widths, bounding contact engagement areas, formed therein; and (e) at least one continuous spacer bridge traversing the width of each window, said at least one bridge of one window being one of laterally adjacent, spaced and out of vertical alignment with respect to said at least one bridge of the other window, wherein there is substantially no vertical overlap of said at least one bridge of one window with respect to said at least one bridge of said other window.

3. A switch in accordance with claim 2 wherein said bridges are elongated and parallel with respect to axes of elongation.

4. A switch in accordance with claim 2 or 3 wherein said electrical contacts are applications of silver conductive ink screen printed onto said surfaces of said laminae.

5. A membrane switch, comprising:

(a) a first switch network including:

(i) a pair of laminae having oppositely facing surfaces and electrical contacts applied to each of said surfaces, said contacts being engagable to close said first switch network upon application of pressure urging said surfaces toward one another; and (ii) at least one continuous spacer bridge intermediate said first switch network surfaces maintaining said contacts spaced from one another; and (b) a second switch network wired in parallel with, and overlying, said first switch network, said second switch network including:

(i) a pair of laminae having oppositely facing surfaces and electrical contacts applied to each of said surfaces, said contacts being engagable to close said second switch network upon application of pressure urging said surfaces toward one another; and (ii) at least one continuous spacer bridge intermediate said second switch network surfaces maintaining said contacts spaced from one another, said at least one second switch network spacer bridge being one of laterally adjacent, spaced and out of vertical alignment from said at least one first switch network spacer bridge, wherein there is no vertical overlap of said at least one first switch network spacer bridge with respect to said at least one second switch network spacer bridge.

6. A method of constructing a large area membrane switch, comprising the steps of:

(a) overlying one switch network with a similarly sized, second switch network;

(b) supporting laminae of each switch network spaced from a corresponding lamina to preclude inadvertant engagement of contacts screened on facing surfaces of laminae of each switch network, wherein continuous support means of one switch network are misaligned and out of vertical alignment with all continuous support means of the second switch network; and (c) wiring the two switch networks in parallel.

* * * * *